US008876501B2

(12) United States Patent
Kawano et al.

(10) Patent No.: US 8,876,501 B2
(45) Date of Patent: Nov. 4, 2014

(54) ELECTRIC PUMP UNIT

(75) Inventors: Akihiko Kawano, Kashiwara (JP); Hiroki Kagawa, Kashiba (JP)

(73) Assignee: JTEKT Corporation, Osaka-Shi (JP)

( * ) Notice: Subject to any disclaimer, the term of this patent is extended or adjusted under 35 U.S.C. 154(b) by 73 days.

(21) Appl. No.: 13/410,559

(22) Filed: Mar. 2, 2012

(65) Prior Publication Data

US 2012/0230850 A1 Sep. 13, 2012

(30) Foreign Application Priority Data

Mar. 11, 2011 (JP) ..... 2011-053807

(51) Int. Cl.

| | |
|---|---|
| ***F04C 29/04*** | (2006.01) |
| ***F04C 15/00*** | (2006.01) |
| ***F04C 11/00*** | (2006.01) |
| *F04C 2/10* | (2006.01) |

(52) U.S. Cl.

CPC ..... *F04C 11/008* (2013.01); *F04C 2/10* (2013.01); *F04C 15/008* (2013.01); *F04C 29/045* (2013.01); *F04C 29/047* (2013.01); *F04C 2240/40* (2013.01); *F04C 15/0096* (2013.01)

USPC ..... 417/423.8

(58) Field of Classification Search

CPC ..... F04C 15/008; F04C 29/0085; F04C 2240/40; F04C 2240/30

USPC ..... 417/423.11, 423.8, 423.14

See application file for complete search history.

(56) References Cited

U.S. PATENT DOCUMENTS

| | | | | |
|---|---|---|---|---|
| 2,734,459 | A * | 2/1956 | Zimsky | 417/357 |
| 5,810,568 | A * | 9/1998 | Whitefield et al. | 417/423.8 |
| 5,997,261 | A * | 12/1999 | Kershaw et al. | 417/366 |

FOREIGN PATENT DOCUMENTS

| | | |
|---|---|---|
| JP | 2008-132941 | 6/2008 |
| JP | A-2008-215088 | 9/2008 |
| WO | WO 2010/090303 A1 | 8/2010 |

OTHER PUBLICATIONS

Jun. 4, 2014 Extended European Search Report issued in European Patent Application No. 12158479.1.

* cited by examiner

*Primary Examiner* — Bryan Lettman
(74) *Attorney, Agent, or Firm* — Oliff PLC

(57) ABSTRACT

A motor housing that accommodates a pump-driving electric motor and a controller that controls the electric motor is fixed to a pump body of a pump that sucks and discharges oil. A sealed motor chamber that accommodates the electric motor is formed within the motor housing. A cooling oil is filled in the motor chamber.

4 Claims, 2 Drawing Sheets

ELECTRIC PUMP UNIT

INCORPORATION BY REFERENCE/RELATED APPLICATION

This application claims priority to Japanese Patent Application No. 2011-053807 filed on Mar. 11, 2011 the disclosure of which, including the specification, drawings and abstract, is incorporated herein by reference in its entirety.

BACKGROUND OF THE INVENTION

1. Field of the Invention

The invention relates to an electric pump unit that is used as a hydraulic pump that supplies hydraulic pressure to, for example, a transmission of a motor vehicle.

2. Discussion of Background

Hydraulic pressure is supplied to a transmission of a motor vehicle by a hydraulic pump. In a motor vehicle in which so-called idling stop is performed, that is, an engine is stopped when the vehicle stops to save energy, an electric hydraulic pump is used to supply hydraulic pressure to a transmission even during idling stop.

Since an electric hydraulic pump for a transmission of a motor vehicle is installed in a limited space in a vehicle body, size reduction of the electric hydraulic pump is required. In addition, weight reduction and cost reduction are also required. To meet these requirements, Japanese Patent Application Publication No. 2008-215088 (JP 2008-215088 A) describes an electric pump unit in which a pump, a pump-driving electric motor and a controller for the electric motor are installed in a single unit housing.

In such a conventional electric pump unit, a motor housing is connected to a pump body that constitutes the pump, and the electric motor and the controller are installed in a sealed motor chamber that is formed in the motor housing. The electric motor is disposed at a position on a pump body side in the motor chamber, and a substrate of the controller is fixed to an end face of the electric motor, which is on the opposite side of the electric motor from to the pump body. In addition, multiple electric and electronic components, such as a capacitor, a FET (Field Effect Transistor), which constitute the controller are attached to the substrate.

The electric pump unit for a motor vehicle is disposed in an engine room of the motor vehicle. Due to heat produced at the stator coils of the electric motor, the temperature of the electric motor and the temperature in the motor chamber increase, and the temperatures of components of the controller in the motor chamber also increase.

SUMMARY OF THE INVENTION

An object of the invention is to provide a lighter and smaller electric pump unit in which increases in the temperatures of a pump-driving electric motor and components of a controller are suppressed by cooling the electric motor.

According to an aspect of the invention, in an electric pump unit, a motor housing that accommodates a pump-driving electric motor and a controller that controls the electric motor is fixed to a pump body of a pump that sucks and discharges oil, and a sealed motor chamber that accommodates the electric motor is formed within the motor housing. Because the coolant is filled in the motor chamber, increases in the temperature of the electric motor and the temperature in the motor chamber due to heat produced by the electric motor are suppressed, and therefore increases in the temperatures of the components of the controller disposed in the motor chamber are also suppressed.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, an embodiment of the invention will be described with reference to the accompanying drawings.

Figure 1:
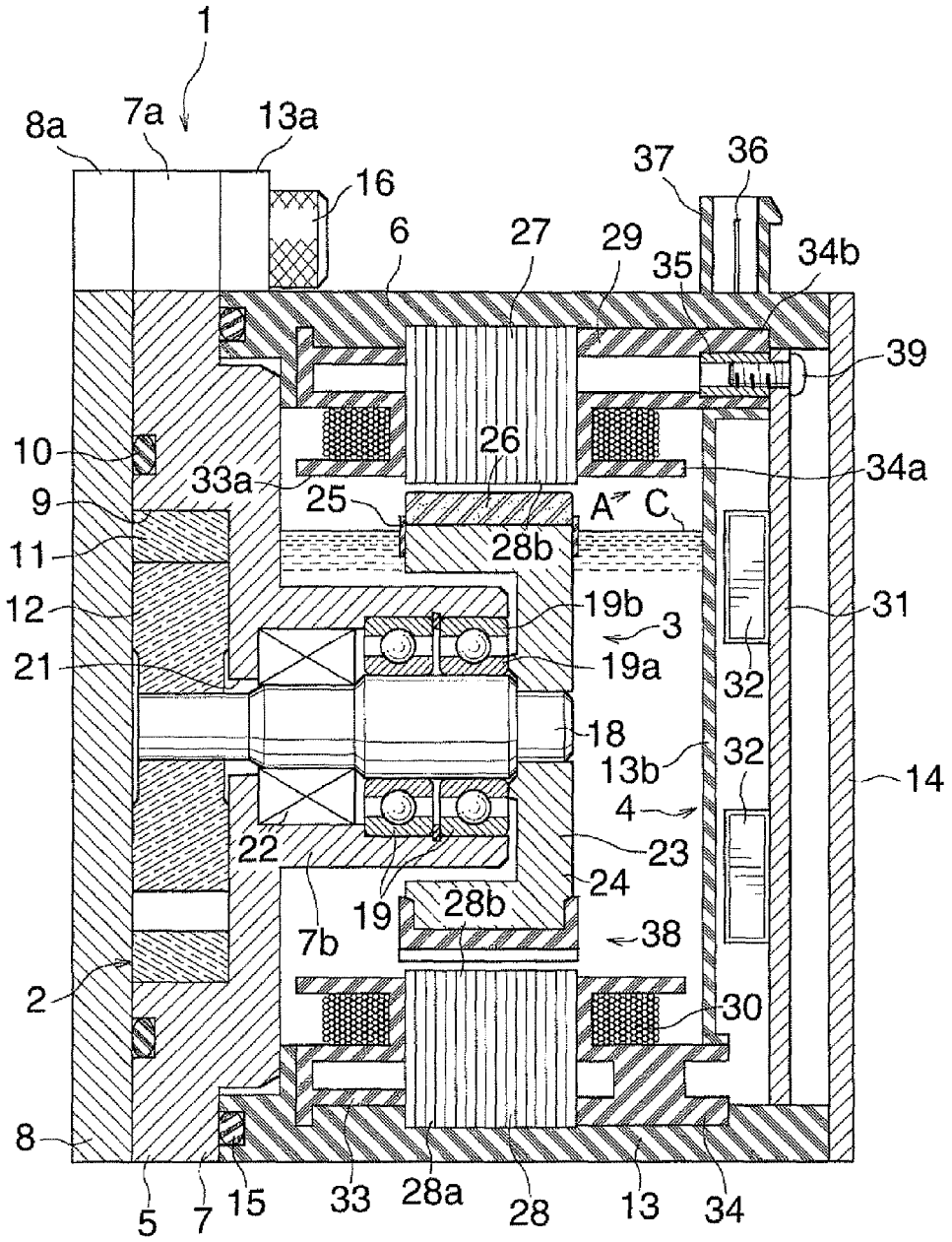
FIG. 1 is a longitudinal sectional view of an electric pump unit according to an embodiment of the invention.

FIG. 1 is a longitudinal sectional view of an electric pump unit according to an embodiment of the invention. In the following description, the left side in FIG. 1 is defined as the front side of the electric pump unit, and the right side in FIG. 1 is defined as the rear side thereof.

In the electric pump unit, a pump 2 that sucks and discharges oil, a pump-driving electric motor 3 and a controller 4 for the electric motor 3, which are assembled together, are disposed within a unit housing 1. The pump 2 is an internal gear pump, and the electric motor 3 is a sensorless controlled DC brushless motor that has three-phase winding wires.

The unit housing 1 is formed of a pump body 5 of the pump 2, and a motor housing 6 that accommodates the electric motor 3 and the controller 4.

The pump body 5 is formed of a pump housing 7 and a pump plate 8 provided on the front side of the pump housing 7. The pump housing 7 has a stepped disc-shape that extends in both directions orthogonal to the front-rear direction. At the center of the pump housing 7, there is formed a pump chamber 9 that is open at its front side. The pump plate 8 is fixed to a front face of the pump housing 7 via an O-ring 10, so that the front side of the pump chamber 9 is closed. An outer gear 11 is rotatably housed in the pump chamber 9. On the radially inner side of the outer gear 11, there is disposed an inner gear 12 that meshes with the outer gear 11. Although not shown in the drawings, an oil suction port and an oil discharge port are formed in the pump housing 7 and the pump plate 8, and the pump plate 8 has an oil suction hole that communicates with the oil suction port, and an oil discharge hole that communicates with the oil discharge port. The pump housing 7 and the pump plate 8 are made of aluminum.

The motor housing 6 is formed of a cylindrical motor case 13 made of resin, and a circular lid 14 fixed to a rear end of the motor case 13. A front end of the motor case 13 is fixed to a rear face of the pump housing 7 via an O-ring 15. The pump plate 8, the pump housing 7 and the motor case 13 are fixed to each other with bolts 16, at a plurality of coupling portions 8*a*, 7*a* and 13*a*. The coupling portions 8*a*, 7*a* and 13*a* are formed integrally with the pump plate 8, the pump housing 7 and the motor case 13 such that the coupling portions 8*a*, 7*a* and 13*a* protrude radially outward from outer peripheries of the pump plate 8, the pump housing 7 and the motor case 13, respectively. A rear-end opening of the motor case 13 is closed by the lid 14.

A cylindrical portion 7*b* that is smaller in diameter than the motor case 13 is formed integrally with a central portion of a rear end face of the pump housing 7. Two bearings 19 provided at a rear portion of an interior of the cylindrical portion 7*b* support a motor shaft 18 that extends in the front-rear direction. An inner ring 19*a* of each bearing 19 is fixed to the motor shaft 18, and an outer ring 19*b* thereof is inserted into the cylindrical portion 7*b*. A front portion of the motor shaft 18 extends through a hole 21 formed in a rear wall of the pump housing 7, and enters the pump chamber 9. The inner gear 12 is coupled to a front end portion of the motor shaft 18. An oil seal 22 is provided between the motor shaft 18 and a portion of the cylindrical portion 7*b*, which is located on the front side of the bearings 19.

A rotator 23 that constitutes the electric motor 3 is fixed to a rear end portion of the motor shaft 18 that protrudes rearward from the cylindrical portion 7*b*. In the rotator 23, a permanent magnet retainer 25 made of resin is fixed to an outer peripheral portion of a cylindrical rotator body 24 that extends radially outward from the rear end of the motor shaft 18 and that surrounds an outer periphery of each bearing 19, and multiple circular segment-shaped permanent magnets 26 are retained at respective positions on the retainer 25, which are spaced equidistantly in the circumferential direction. The axial position of the center of gravity of a rotary portion that includes the motor shaft 18, the rotator 23 and the inner gear 12 of the pump 2 is located within the axial span of the bearings 19.

A stator 27 that constitutes the motor 3 is fixed to an inner periphery of the motor case 13 that faces the rotator 23. In the stator 27, an insulator 29 is fitted to a core 28 formed by laminating multiple steel plates, and coils 30 are wound on portions of the insulator 29. The stator 27 is molded integrally with an inner peripheral portion of the motor case 13.

A substrate 31 of the controller 4 is fixed to a rear end of the insulator 29. Components 32 that constitute the controller 4 are mounted on the substrate 31. Although FIG. 1 shows only components 32 that are mounted on a front face of the substrate 31, components 32 may be disposed at predetermined positions on at least one of the front face and a rear face of the substrate 31.

Figure 2:
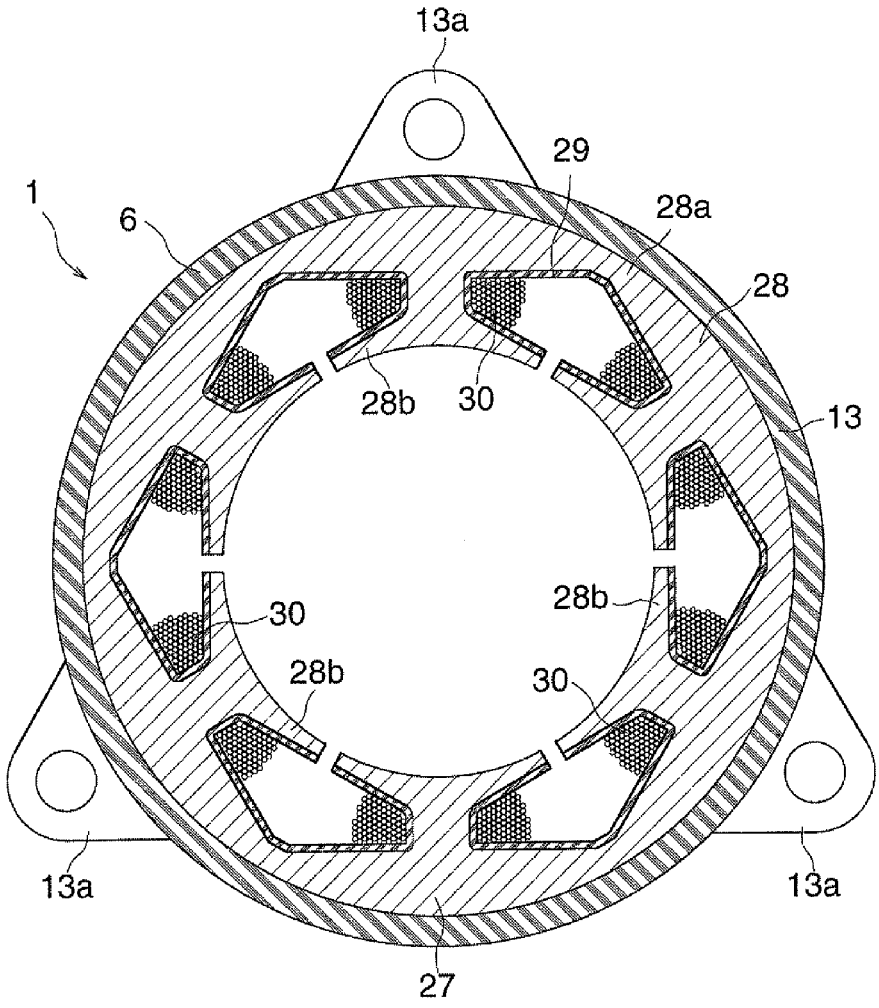
FIG. 2 is a cross-sectional view of the electric pump unit shown in FIG. 1.

FIG. 2 is a cross-sectional view showing a molded article that is formed of the motor case 13 and the stator 27.

As shown in FIG. 2, the core 28 has an annular portion 28*a* and pole portions 28*b* formed integrally with the annular portion 28*a*. The pole portions 28*b* protrude radially inward from respective positions (six positions, in the embodiment) of the inner periphery of the annular portion 28*a*, which are spaced equidistantly in the circumferential direction. A distal end portion of each pole portion 28*b* extends in the two opposite directions along the circumference, and inner peripheral faces of the distal end portions of the pole portions 28*b* define a cylindrical plane.

The insulator 29 is formed of a pair of front and rear halves 33 and 34. The halves 33 and 34 are made of a resin such as PPS (polyphenylene sulfide), and are fitted onto the core 28 from the front and rear sides thereof so as to cover the faces of the core 28 except an outer peripheral face of the annular portion 28*a* and inner peripheral faces of the pole portions 28*b*. The halves 33 and 34 have coil attachment portions 33*a* and 34*a*, respectively, which cover portions of the pole portions 28*b* of the core 28 except the inner peripheral faces of the pole portions 28*b*. Coils 30 are wound around portions of the pole portions 28*b* of the core 28, which are covered with the coil attachment portions 33*a* and 34*a* of the halves 33 and 34. Projections 34*b* for the substrate 31 that extend rearward are formed integrally with a portion of the rear half 34, which is on the radially outer side of the coil attachment portions 34*a*. The projections 34*b* are formed at respective positions (six positions, in the embodiment) which are spaced equidistantly in the circumferential direction. A metal internal threaded member 35 of which the inner periphery has an internal thread is embedded in a rear end portion of each projection 34*b*.

The motor case 13 is integrated with the stator 27 by molding a resin such as PA66 (polyamide 66) to a radially outer side portion of the stator 27 with the use of a mold. The motor case 13 covers an outer peripheral face of the core 28 and portions of the insulator 29 that are radially outward of the coil attachment portions 33*a* and 34*a*. The coils 30 of the stator 27 are not covered with the motor case 13, and are exposed. A partition 13*b* is formed integrally with the inner periphery of a portion of the motor case 13, which is on the rear side of the stator 27. The projections 34*b* of the rear half 34 of the insulator 29 extend rearward beyond the partition 13*b*. A connector 37 provided with a plurality of pins 36 is formed integrally with an outer periphery of the motor case 13.

The lid 14 is made of resin, and is fixed to the rear end of the motor case 13 by, for example, thermal welding.

When the motor case 13 closed by the lid 14 is fixed to the pump housing 7, a sealed motor chamber 38 that accommodates the electric motor 3 is formed between the partition 13*b* and the pump housing 7 inside the motor case 13.

The substrate 31 of the controller 4 is disposed in a space between the lid 14 and the partition 13*b* inside the motor case 13, and is fixed to the internal threaded members 35 of the projections 34*b* of the insulator 29 with screws 39. Although not shown in the drawings, a plurality of bus bars are installed in the molded article formed of the insulator 29 and the motor case 13. With these bus bars, the coils 30 of the stator 27 are electrically connected to each other, and are electrically connected also to the substrate 31. The pins 36 of the connector 37 are also electrically connected to the substrate 31.

An oil C, which is an electrically insulative coolant, is filled in the motor chamber 38 that accommodates the electric motor 3. The oil C occupies approximately 80 to 90% of the volume of the internal space of the motor chamber 38, and the remainder of approximately 10 to 20% is occupied by air A. The oil C used for the motor chamber 38 may be the same kind of oil that is used in the pump 2.

In the foregoing electric pump unit, as the electric motor 3 is driven, the inner gear 12 rotates and the pump 2 operates. At this time, the relatively low-temperature oil flows in the pump body 5, and the oil C in the motor chamber 38 is cooled by the pump housing 7, which has high heat conductivity and large heat capacity. Then, the oil C cools the electric motor 3, which suppresses increases in the temperature of the electric motor 3 and the temperature in the motor chamber 38 due to the heat produced by the electric motor 3. As a result, increases in the temperatures of the components 32 on the substrate 31, which are located next to the oil C via the partition 13*b*, are also suppressed. Because the coils 30 of the stator 27 of the electric motor 3 are exposed to the space inside the motor chamber 38 and therefore are in contact with the oil C, the electric motor 3 is efficiently cooled. Because the oil C is an insulator, the contact of the oil C with the electric motor 3 does not cause any problem. Because the substrate 31 is disposed within the space separated from the motor chamber 38 by the partition 13*b*, the substrate 31 does not contact the oil C, and is not subject to any adverse effect of oil. The oil C has an effect of preventing rusting of the electric motor 3. Because the bearings 19 are lubricated by the oil C and need not be sealed, open type bearings, which are inexpensive, may be used as the bearings 19. The thermal expansion of the oil C in the motor chamber 38 is absorbed by the air present in the motor chamber 38.

If the substrate 31 and the components 32 on the substrate 31 which constitute the controller 4 have oil resistance, the entire internal space of the motor case 13 may be used as a motor chamber without providing the partition 13*b*, and both the electric motor 3 and the controller 4 may be accommodated in the motor chamber.

In the above-described embodiment, the rotator 23 has a construction in which the multiple permanent magnets 26 are retained by the permanent magnet retainer 25 made of resin which is fixed to the outer peripheral portion of the cylindrical rotator body 24. Therefore, there is no need to fix the permanent magnets 26 to the rotator body 24 with an adhesive, and the permanent magnets 26 do not fall off even if the permanent magnets 26 are used in the oil C.

The overall construction of the electric pump unit and the constructions of individual portions thereof are not limited to those described in the embodiment, but may be changed or modified as appropriate.

Further, the invention is also applicable to electric pump units other than electric pump units for transmissions.

What is claimed is:

1. An electric pump unit comprising:

a pump that sucks and discharges a first oil, and that includes a pump body;

a pump-driving electric motor including a rotator;

a controller that controls the pump-driving electric motor;

a motor housing that has a sealed motor chamber that accommodates the pump-driving electric motor and the controller, the motor housing being fixed to the pump body; and a coolant and air filled in the motor chamber and not in fluid communication with the first oil, wherein the coolant is in fluid communication with at least (i) the air in the motor chamber, (ii) the rotator, and (iii) the controller.

2. The electric pump unit according to claim 1, wherein the coolant is a second oil.

3. The electric pump unit according to claim 2, wherein 80 to 90% of a volume of a space in the motor chamber is occupied by the second oil, and a remainder of 10 to 20% is occupied by the air.

4. The electric pump unit according to claim 1, wherein at least a portion of a coil of the electric motor is exposed to a space in the motor chamber, and is in contact with the coolant.

* * * * *